United States Patent [19]

Croley

[11] 4,042,164

[45] Aug. 16, 1977

[54] CONTAINER END STRUCTURE

[75] Inventor: Thomas E. Croley, Worthington, Ohio

[73] Assignee: Corco, Inco., Worthington, Ohio

[21] Appl. No.: 749,293

[22] Filed: Dec. 10, 1976

[51] Int. Cl.[2] ..... B65D 3/04; B65D 13/04

[52] U.S. Cl. ..... 229/23 BT; 229/5.7; 229/23 A; 229/21

[58] Field of Search ..... 229/5.6, 5.7, 17 B, 229/21, 23 A, 23 BT, DIG. 3

[56] References Cited

U.S. PATENT DOCUMENTS

| | | | |
|---|---|---|---|
| 2,016,863 | 10/1935 | La Grua | 229/23 A X |
| 2,357,092 | 8/1944 | Demian et al. | 229/5.7 X |
| 2,718,996 | 9/1955 | Jamieson | 229/23 A |
| 2,794,588 | 1/1957 | George et al. | 229/5.7 X |
| 3,146,931 | 9/1964 | Neff et al. | 229/7 |
| 3,314,586 | 4/1967 | Frank, Jr. | 229/23 BT |
| 3,563,448 | 2/1971 | Crolby | 229/23 BT |
| 3,598,303 | 8/1971 | Folz | 229/DIG. 3 |
| 3,972,454 | 8/1976 | Croley | 229/17 B X |

*Primary Examiner*—Davis T. Moorhead
*Attorney, Agent, or Firm*—Wm. V. Miller

[57] ABSTRACT

An end structure for a container body which is of tubular form and of multisided polygonal transverse cross section. It comprises a flat substantially disc-like end with attaching flanges hinged thereto and extending inwardly from the plane thereof, being in number equal to the sides of the body and substantially equal in lateral extent. The attaching flanges are hinged to the disc-like end by an arrangement which permits the end structure to be fitted into position within or exteriorly of the tubular container body and to be fastened in position by means of the attaching flanges.

7 Claims, 13 Drawing Figures

FIG. 1
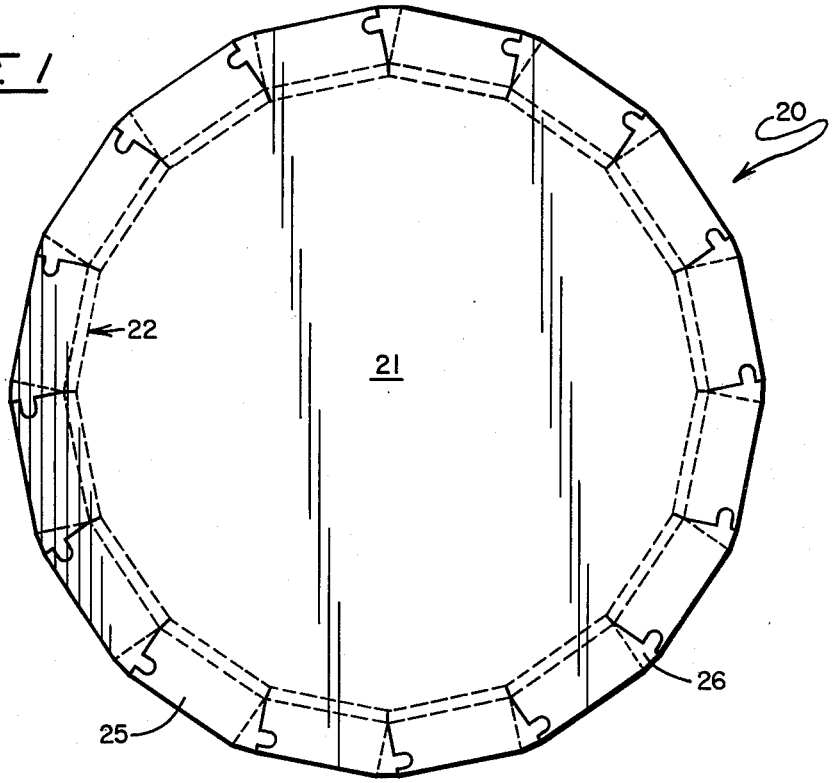
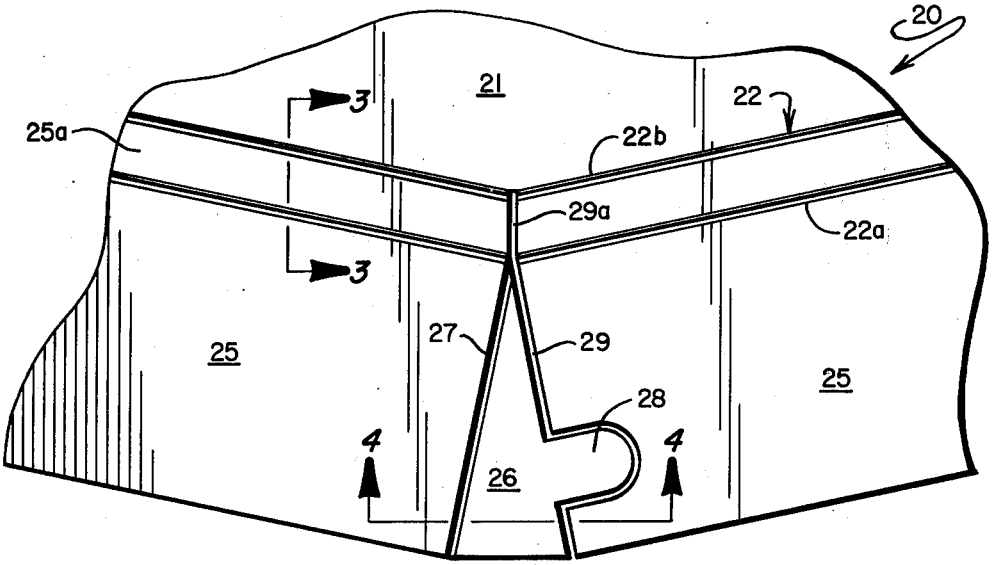
FIG. 2

CONTAINER END STRUCTURE

BACKGROUND OF THE INVENTION

This invention deals with a container end structure or closure of the general type disclosed in my issued U.S. Pat. No. 3,563,448 dated Feb. 16, 1971 and shown in use in a container for bulk material in my issued U.S. Pat. No. 3,972,454, dated Aug. 3, 1976.

SUMMARY OF THE INVENTION

The present invention deals with a particular arrangement of the attaching flanges of the end structure of the type disclosed in said patents whereby the use of the end structure at either end of the container body is facilitated. This arrangement makes it possible for the end structure to telescope with the body at its top or bottom end, either exteriorly or interiorly of the body or to use it flat at the bottom, if desired. This is accomplished mainly by having a precise, predetermined score-line and slit arrangement in the end structure where the attaching flanges are hingedly connected to the disc-like end thereof.

BRIEF DESCRIPTION OF THE DRAWINGS

The best mode contemplated in carrying out this invention is illustrated in the accompanying drawings in which:

FIG. 1 is a schematic plan view of an end structure or closure in which this invention is embodied;

FIG. 2 is an enlarged plan view of a segment of the blank;

DETAILED DESCRIPTION OF THE DRAWINGS

Figure 3:
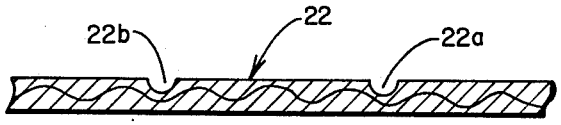
FIG. 3 is a sectional view taken along line 3—3 of FIG. 2.

With reference to the drawings, the container end structure is designated generally as 20 in FIG. 1 and is, in its general structure, similar to that disclosed in U.S. Pat. No. 3,563,448. It is shown applied to the lower end of a container, as in that patent, in FIG. 5, the container body being designated generally by the numeral 10.

In the drawings, the container end structure 20 and the container body 10 are of complemental polygonal cross section, the body of the container shown having sixteen sides and the end structure having a similar number of sides. However, it is to be understood that this invention is applicable to polygonal forms of any number of sides.

Figure 5:
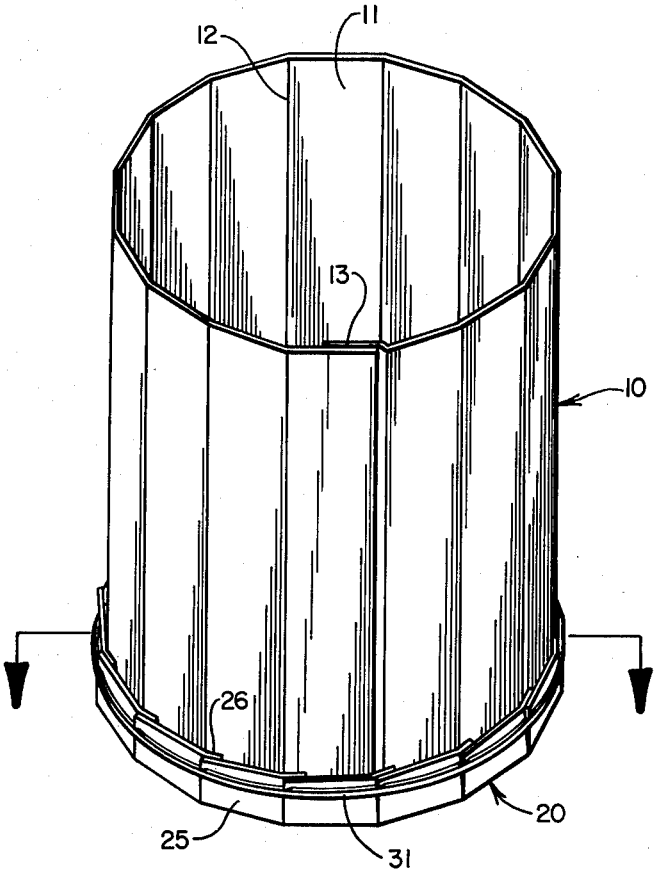
FIG. 5 is a perspective view with the end structure applied in telescoping relationship to the exterior of the container body.
Figure 6:
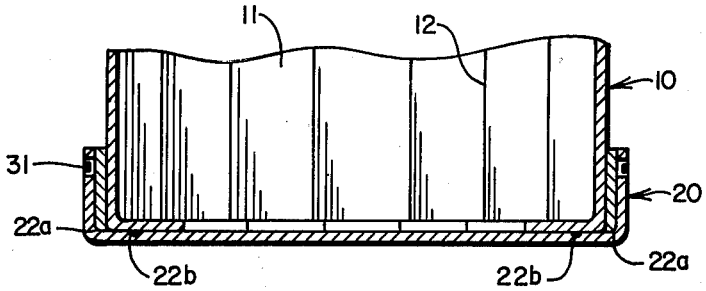
FIG. 6 is a vertical sectional view taken along line 6—6 of FIG. 5.

The container body 10 is disclosed in my previous patents and is shown best in FIGS. 5 and 6. The tubular body, as formed, is open at both ends and comprises the sides 11 which are in the form of flat panels joined at the score lines 12 which extend the full length of the tubular body. The body can be formed from a single flat blank of fiberboard or similar material which is scored at the lines 12 and which has its longitudinal edges overlapped and secured together as indicated at 13. Flanges 14 are hinged at transverse score lines to the lower ends of the side panels 11 and are coextensive therewith. When the container is assembled, these flanges will extend radially inwardly in a plane disposed at a right angle to the axis of the tubular body 10 (FIG. 6). If a closure is provided at the top of the tubular body, these flanges may or may not be provided as desired.

The closure end unit 20 of this invention is applied to either or both ends of the tubular body 10 but is shown as being at the bottom end.

Figure 4:
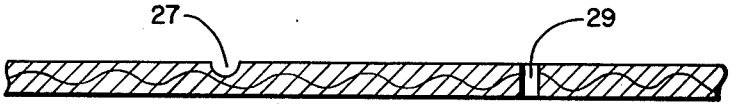
FIG. 4 is a sectional view taken along line 4—4 of FIG. 2.

The blank for the end structure or closure 20 is shown schematically in FIG. 1 and in this Figure all of the score lines are indicated as broken lines whereas actual cuts or slits are indicated by full lines. Actual structure of the blank at the score lines and slits is shown in FIGS. 2, 3 and 4.

The closure unit 20 comprises a flat, substantially disc-like body 21 but which has an outer peripheral edge of polygonal outline where the double-score or hinge lines 22 connect to the attaching flanges 25. The flanges 25 correspond in number to the panel sides 11 of the tubular body 10 and, in the example illustrated, this is 16. Each flange 25, at one of its lateral edges, is provided with a triangular tab 26 which is hinged to that edge along a score line 27 and which on its other free angularly disposed edge, provided by slit 29, is provided with a lateral extension ear 28. The opposite edge of each flange is provided by the slit 29 with a complemental band-receiving notch 30. These notches are spaced outwardly from the double-score hinge line 22.

As described in my prior patents, the flanges 25 are folded successively inwardly and upwardly relative to the disc-like body 21, as indicated in FIGS. 5 and 6 into tray form, so that the triangular tab 26 of the one flange will be inwardly of the adjacent edge of the next flange. This will expose the notches 30 on the edges 29 of successive flanges. As indicated in FIGS. 5 and 6, a suitable retaining band 31, which may be of metal, may be tightened around the upstanding flanges 25 to hold them in tight, frictional relationship with the sides 11 of the tubular body 10.

The closure unit may be formed from a single substantially circular blank of fiberboard or the like, as indicated in FIG. 1, except that the outer peripheral edge will be trimmed as indicated to provide a disc 21 having sixteen angular edges. As indicated, this blank is double-scored at 22 to provide the separate flanges 25 along with the ears or lugs 28 and complemental notches at opposite edges. Score lines 27 are also provided to form on the flanges 25, the triangular tabs 26 hinged to the lateral edge of each of the respective flanges. The resulting structure can be formed into a closure element by the successive inward folding of the flanges 25 in the manner now to be described so that it can be used exteriorly or interiorly. When the flanges 25 are folded at a right angle to the disc 21, they will overlap each other and provide a siftproof joint as well as a structurally strong joint as described in my previous patents. The closure element 20 will be easily made with a minimum waste of material by simple scoring and slitting operations, but it is to be understood that instead of actual slitting operations, perforating operations could be used to permit subsequent slitting or separating.

Figure 7:
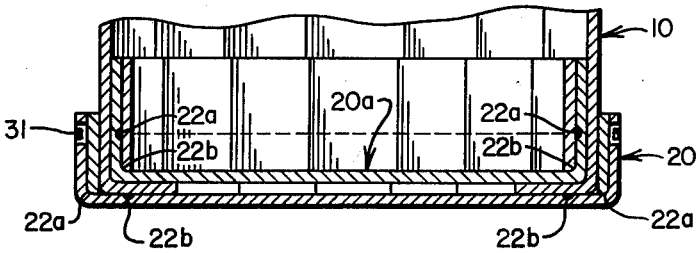
FIG. 7 is a vertical sectional view showing the use of the end structure both inside and outside the lower end of the body in telescoping relationship thereto.
Figure 8:
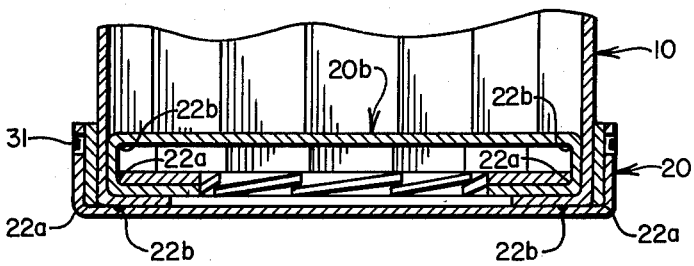
FIG. 8 is a vertical sectional view but showing the end structure inside in flat condition.
Figure 8A:
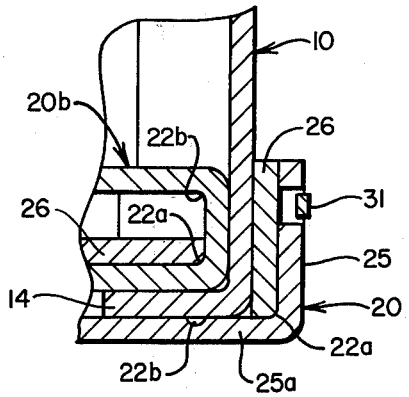
FIG. 8*a* is an enlarged view of an adjacent corner of the container bottom.

As indicated, the closure unit 20 may be used at the bottom of the container body 10 as shown in FIGS. 5 and 6 or may be used at the top. So it can be used either exteriorly of the container body 10, as shown in FIG. 6, or interiorly as shown in FIGS. 7 and 8, the double score line 22 is provided and is definitely related to the thickness of the container body, which may be single wall as shown or several layers or plies, as well as to the thickness of flanges 25 and connected tabs 26, and is also related to the angular disposition of the scores 27 and slits 29 which form the respective tabs 26. This angular disposition will vary with the number of flanges 25 which depends on the number of sides of the container body.

Figure 6A:
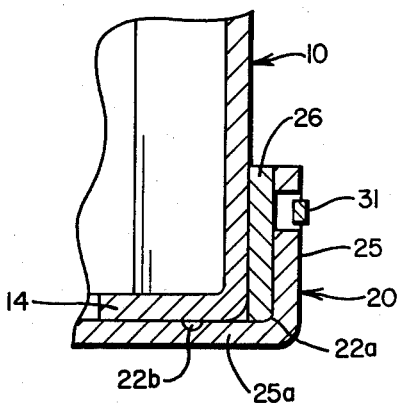
FIG. 6*a* is an enlarged view of an adjacent corner of the container bottom.
Figure 7A:
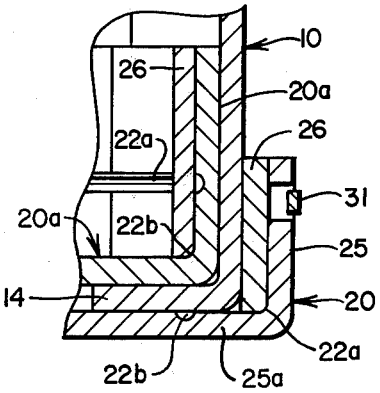
FIG. 7*a* is an enlarged view of an adjacent corner of the container bottom.

Thus, the double score 22 comprises the outer hinge score lines **22*a* and the inner hinge score lines 22*b*. These hinge lines will be disposed parallel with each other and will be spaced apart a predetermined distance. The hinge lines 22*a* will be disposed at relative angles, the same as the angular disposition of the panels 11 of the container body wall 10 with which they are designed to cooperate. Thus, the area or section 25*a* between each pair of score lines 22*a* and 22*b* is, in effect, a continuation of the corresponding attaching flange 25. These areas are separated by a slit 29*a*, which is a continuation of the slit 29 and which extends inwardly to the inner score lines 26*b*. This slit 29*a* is in bisecting relationship to the angle of the tab 26 formed by score line 27 and slit 29. With this double score line, the flange 25 may be folded at the outer hinge line 22*a*, or it may be folded at the inner hinge line 22*b* together with the section 25*a* and will then be an attaching flange of greater depth. In the first instance, this will dispose the upstanding flange 25 outside the container body 10 in telescoping relationship as shown in FIGS. 5, 6 and 6*a*, with the lower end of the container wall resting on the sections 25*a* which will be horizontal. In the second instance, this will dispose the upstanding flange 25 within the container body 10 in telescoping relationship, this closure being designated as 20*a* in FIGS. 7 and 7*a*. It will be noted that here the flanges 25 are bent upwardly, along with the connected sections 25*a*, along the inner hinge lines 22*b*. Therefore, the spacing of the respective pairs of lines 22*a* and 22*b* must be sufficient to accomodate the thickness of the flanges 25 and overlapping tabs 26 plus the wall thickness of the container. Thus, in this instance, assuming the fiberboard of container wall 10** and the closure blank is the same thickness, it would be related to three times the thickness of the fiberboard.

The closure element could also be used flat as indicated in FIGS. 8 and **8*a* where it is designated 20*b*. In this use, the flanges 25 could be tucked beneath the body 21 about the inner fold lines 22, 22*a* and 22*b***, as shown, or folded over the top of the body (not shown).

In each instance, staples or other fasteners may be passed through the adjacent contacting parts of various elements. If desired also, the bottom structure may be fastened to a pallet or other support as described in my previous patents.

Figure 9:
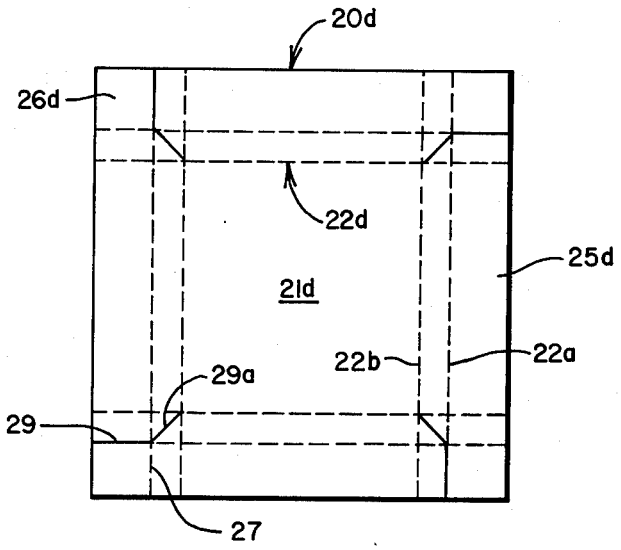
FIG. 9 is a schematic plan view of an end structure or closure of a second embodiment of this invention.

As indicated, the container body and the cooperating closure element or end structure may have various numbers of sides. It is preferred to use a large number of sides so as to approach a container of cylindrical form, 16 being given as an example but 20 or 24 are desirable. Also lesser numbers of sides could be used, such as 12, eight, six or four as shown in FIG. 9. Even triangular containers could be provided embodying this invention.

A quadrangular, for example, a square closure element **20*d* is shown in FIG. 9. Here again broken lines indicate score lines and full lines indicate slits. The body is shown at 21*d*, the attaching flanges at 25*d* and the tabs at 26*d*. The double score line is indicated at 22*d* and consists of an inner score line 22 and an outer score line 22*a*. Each tab is formed by a score line 27 and a slit 29. It will be noted that a continuation 29*a* of the slit 29 bisects the tab 26*d* of the angle formed by the lines 27 and 29 which are at the adjacent edges of adjacent flanges 25*d***.

Figure 10:
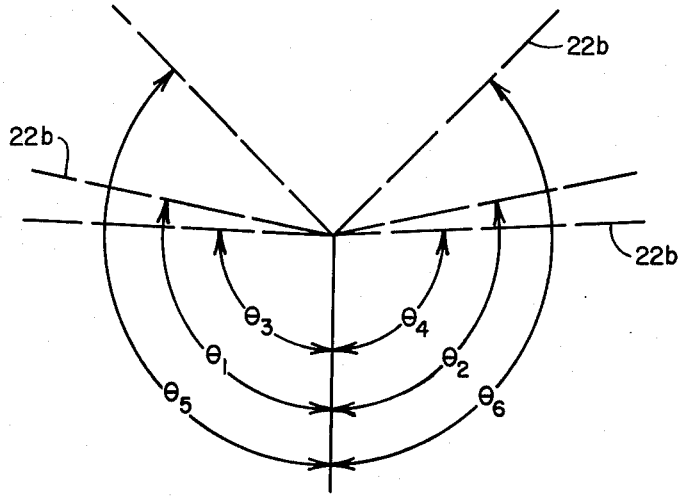
FIG. 10 is a schematic view indicating the possibility of applying the invention to containers of various numbers of sides.

In each instance, each end structure, regardless of the number of sides of the polygon, would have attaching flanges corresponding to the flanges 25, with tabs 26 between adjacent flanges. Also, an equivalent of the double score line 22 would be provided to produce sections corresponding to the sections **25*a* which would be separated by a slit corresponding to the slit 29*a*. This slit 29*a* would always bisect the tab 26 or the angle formed by the adjacent edges of adjacent flanges 25 which correspond to the score lines 27 and cooperating slits 29. This relationship is indicated by the diagram shown in FIG. 10**.

In this figure, the angular relationship of the slit **29*a* and the pair of score lines 22*b* are indicated and it will be the same for the other pair of score lines 22*a*. Three different angular arrangements of the pairs of score lines 22*b* are illustrated from one having a minimum angle, and, therefore, a maximum number of sides on the polygon, to one where a polygon of square form would be produced, which would be a much greater angle. In each example, the slit 29*a* would be at the same angle $\theta$ with each of the adjacent score lines 22*b***. Thus:

$$\theta_1 = \theta_2$$

$$\theta_3 = \theta_4$$

$$\theta_5 = \theta_6$$

It will be apparent that the minimum angle between the slit **29*a* and either score line 22*b***, must be over 90° and to obtain a square, as indicated, it would be 135°, which is usually the maximum it is desired to use although it could be increased to obtain a triangular structure. As indicated, as the angle $\theta$ decreases, the number of sides of the polygon increases. For example, for the 16 sides, each angle of the pair or $\theta$ would be 101.25° and for the square, as indicated above, it would be 135°. The formula for computing this would be:

$$\theta = \left\{ \frac{360^\circ}{\text{number of sides} \times 2} \right\} + 90^\circ$$

16 sides $\theta = 101.25^\circ$ 4 sides (square) $\theta = 135^\circ$

It will be apparent that this invention provides an end structure blank for use with a polygonal container body having any number of sides. The end structure blank will be of a corresponding polygonal form with attaching flanges provided at its respective sides. These, flanges are connected to the blank so that it can be used either outside or inside the container body, the connection being by means of the special double score line arrangement which consists of pairs of score lines with the inner and outer score lines spaced a predetermined distance, with the pairs of score lines angularly disposed to form a polygonal outline complemental to the container body and with the lines of adjacent pairs coming together at a vertex at a selected angle depending on the number of sides of the polygon. A slit extends from each vertex of the inner score line to the corresponding vertex of the outer score line and the centerline of this slit is at a predetermined angle to provide separate angularly-disposed connecting flanges, and a slit also extends on from that slit to the outer edge of said blank to provide separate attaching flanges connected to said blank by the respective angularly-disposed connecting flanges.

Having thus described this invention what is claimed is:

1. An end structure for a tubular container of polygonal cross section comprising a substantially disc-like blank having an outer peripheral edge, said blank having a double score line inwardly of its edge and extending completely therearound and consisting of an inner score line and an outer score line in spaced parallel relationship and spaced inwardly of the edge of said blank to provide pairs of double score lines angularly disposed to form a polygonal outline complemental to the container body with which it is to be used, the lines of adjacent pairs coming together at a vertex and the lines being at a selected angle depending on the number of sides of the polygon, a slit extending from each vertex of the inner score line to the corresponding vertex of the outer score line to provide separate angularly-disposed connecting flanges, and a slit extending on from that slit to the outer edge of said blank to provide separate attaching flanges connected to said blank by the respective angularly-disposed connecting flanges.

2. A blank according to claim 1 in which each flange slit extending between the vertices has its centerline at an equal angle relative to each of the adjacent flange-forming score lines.

3. A blank according to claim 2 in which each of the latter slits is at an angle to the former slit and is a continuation thereof, a hinge score line extending from each of the former slits and disposed at an angle relative to each of the latter slits so that the resulting tab produced therebetween will be a triangular tab hinged to the adjacent attaching flange and free at its other edge of the other adjacent attaching flange.

4. A blank according to claim 3 in which a continuation of the said centerline of each of the flange slits bisects the corresponding triangular tab.

5. A blank according to claim 4 in which each tab has a lug on its free edge and the adjacent edge of each attaching flange has a complemental lug-receiving notch.

6. A blank according to claim 3 in which the spacing of the inner and outer score lines is sufficient to accomodate the thickness of the material of a tab and flange plus the thickness of the wall of the tubular container with which it is to fit.

7. A blank according to claim 2 in which its outer edge is of the same polygonal outline as the polygonal cross section of the container, and each of the double score lines is also parallel to that edge.

* * * * *